United States Patent [19]

McIntosh, Sr. et al.

[11] 4,226,410

[45] Oct. 7, 1980

[54] STACKING SYSTEM FOR FANFOLD PAPER AND THE LIKE

[75] Inventors: Robert A. McIntosh, Sr., Nashua; Richard G. Bernier, Derry, both of N.H.; David A. Estabrooks, Andover, Mass.

[73] Assignee: Centronics Data Computer Corporation, Hudson, N.H.

[21] Appl. No.: 898,418

[22] Filed: Apr. 20, 1978

[51] Int. Cl.[3] ..... B65H 45/101

[52] U.S. Cl. ..... 270/61 F; 226/198; 400/613.2

[58] Field of Search ..... 270/52.5, 61 F, 79; 400/613.2–613.4; 226/119, 196, 198

[56] References Cited

U.S. PATENT DOCUMENTS

| | | | |
|---|---|---|---|
| 3,188,080 | 6/1965 | Kelliher | 270/61 F |
| 3,807,724 | 4/1974 | Bartz | 270/61 F |
| 3,958,798 | 5/1976 | Bower | 270/52.5 |
| 4,094,498 | 6/1978 | Schueler | 270/52.5 |

FOREIGN PATENT DOCUMENTS

| | | | |
|---|---|---|---|
| 2549165 | 5/1977 | Fed. Rep. of Germany | 400/613.2 |

*Primary Examiner*—Paul T. Sewell

*Attorney, Agent, or Firm*—Weinstein & Sutton

[57] ABSTRACT

Fanfold paper emerges from an outfeed slot in a printer along a paper guide extender and falls by gravity into a paper basket to resume its original fanfold configuration. The paper slides between the extender and an upper paper forming guide which is slightly curled at its lower end to force the paper against the lower end of the paper guide extender to cause the paper to neatly fan fold within the basket.

A wedge-shaped member is preferably provided upon the floor of the paper basket to urge the stacked paper into an inverted, slighty V-shaped configuration to further assure neat stacking and prevent corners of the paper from catching a perforation in the paper which would otherwise prevent neat stacking.

14 Claims, 10 Drawing Figures

STACKING SYSTEM FOR FANFOLD PAPER AND THE LIKE

BACKGROUND OF THE INVENTION

The present invention relates to paper stacking systems and, more particularly, to a novel system for stacking fanfold paper, fanfold forms, and the like without the need for constant operator attention and through a system design that consists of no moving parts.

Paper stacking systems are well known and are utilized in a wide variety of applications. One typical application is that in which fanfold paper and/or forms are fed into printers and the like for printing data typically outputted from a computer, the data being outputted in a high-speed fashion. The paper is withdrawn from a supply carton and passed into and through the printer where printing takes place. The paper is then fed, typically in an incremental or line-by-line fashion, through an output slot in the printer in order to be stacked in a paper stacker or basket. Baskets are conventionally designed to stack a substantially large amount of paper. However, it has been found that the paper will not stack neatly, requiring rather frequent operator attention in order to realign the improperly folded paper. Even slight drafts or air currents within the room occupied by the printer equipment will cause such uneven stacking, resulting in the requirement for constant operator attention to straighten the stack. Testing has shown that conventional paper baskets allow the folding of three to five sheets of fanfold paper before intervention of a technician was necessary. Such constant attention necessarily prevents the operator from performing other, more important duties.

To date, the only techniques for assuring neat stacking are those requiring expensive mechanical paper stacking mechanisms requiring drive means and comprised of a large number of moving parts.

BRIEF DESCRIPTION OF THE INVENTION

The present invention is characterized by providing a paper stacking system which has no moving parts and is quite simplified in both design and use, as well as being adapted to stack fanfold paper at heights of greater than ten inches before requiring any operator intervention.

The present invention is characterized by being comprised of a diagonally aligned paper extender guiding paper to slide therealong in a generally diagonally downward direction whereupon the paper moves through a vertical region without engaging any guide means whatsoever before falling upon the floor of a paper basket having a pair of side walls adapted to stack the paper sheets and in a perfectly vertical upright stack to heights of well over twelve inches.

A paper forming guide, preferably formed of either a precurled plastic sheet or a thin resilient metallic sheet, lightly rests upon the surface of the paper as it slides along the paper extender. The lower end of the paper forming guide curls about the lower end of the paper extender, biasing the paper towards the lower curved portion of the extender to urge the paper to assume a neat fanfold within the paper basket.

A wedge-shaped member such as a bar, rod or wedge-shaped sheet of plastic is preferably positioned upon or slightly above the floor of the paper basket to cause the center of the paper sheets to occupy a rest position within the paper basket which is slightly above the sides of the paper, causing the paper to assume an inverted, slightly V-shaped configuration. This prevents the paper corners from engaging the perforations along the side edges of previously stacked paper sheets to prevent the formation of a sloppy stack.

Exhaustive experimentation has shown that the average height of a stack between successive operator interventions is greater than twelve inches.

BRIEF DESCRIPTION OF THE FIGURES AND OBJECTS OF THE INVENTION

It is, therefore, one object of the present invention to provide a novel, inexpensive system for stacking fanfold paper and the like, which system requires no moving parts or complex mechanical mechanisms and which is comprised of cooperating paper extender guide and upper paper guide members which are positioned on opposite sides of the paper moving therebetween and serve to urge the sheets into their original fanfold configuration so as to assume a neat fanfold stack within a paper basket positioned therebelow to form neat stacks without need for constant operator intervention.

Still another object of the present invention is to provide stacking apparatus of the type described hereinabove and wherein the upper paper guide is formed of a thin guide sheet having at least a curled lower end for lightly urging the paper sheets against the lower end of the lower paper guide.

Still another object of the present invention is to provide paper stacking apparatus of the type described hereinabove and wherein the lower end of the upper paper guide is designed to contact the paper surface at three spaced points which may be considered to define the corners of a triangle to impart the desired curl to the paper being stacked.

Still another object of the present invention is to provide a paper stacking apparatus including a paper basket for receiving and stacking fanfold paper and/or forms wherein the floor of the paper basket is provided with a centrally located support member to cause the stacked paper to assume an inverted, slightly V-shaped contour which further aids in the neat stacking of the fanfold paper.

The above as well as other objects of the present invention will become apparent when reading the accompanying description and drawings in which:

FIG. 1 is a three-quarter perspective showing the paper stacking system of the present invention mounted upon the rear of a high-speed printer.

FIG. 1*a* shows a side elevational view of the printer and paper stacking system of FIG. 1.

Figure 3:
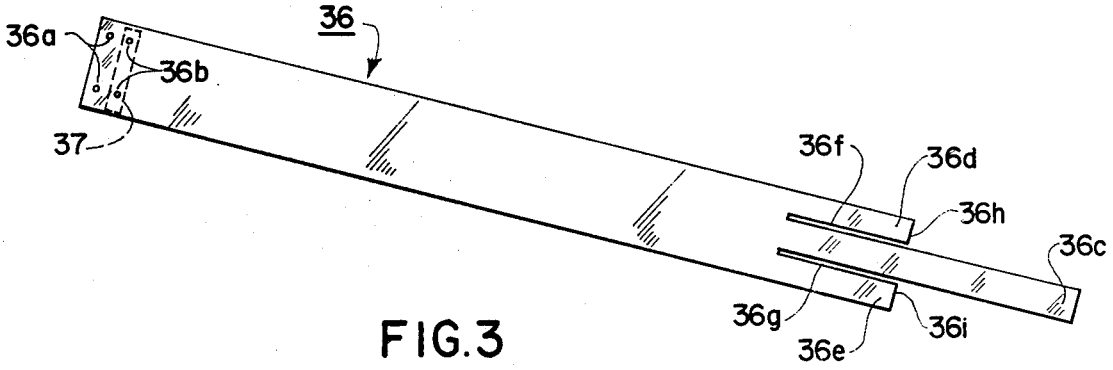
FIG. 3 shows a top plan view of the paper forming guide of FIG. 1, showing details thereof.
Figure 3A:
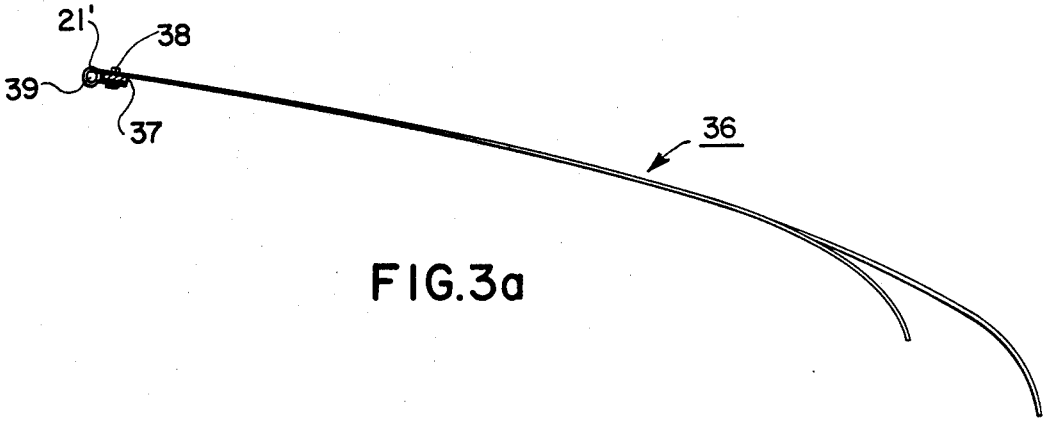

FIG. 3*a* shows a side view of the paper forming guide of FIG. 3.

Figure 3B:
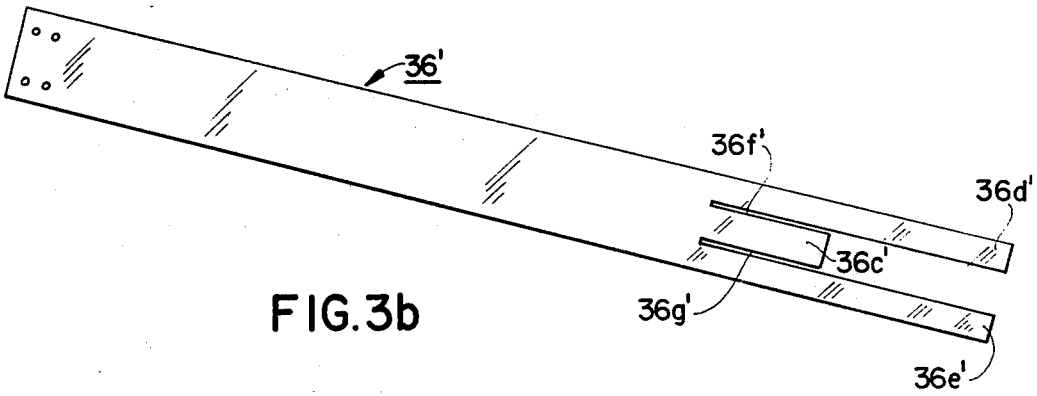

FIG. 3*b* shows a top plan view of an alternative embodiment to the paper forming guide of FIG. 3.

Figure 1:
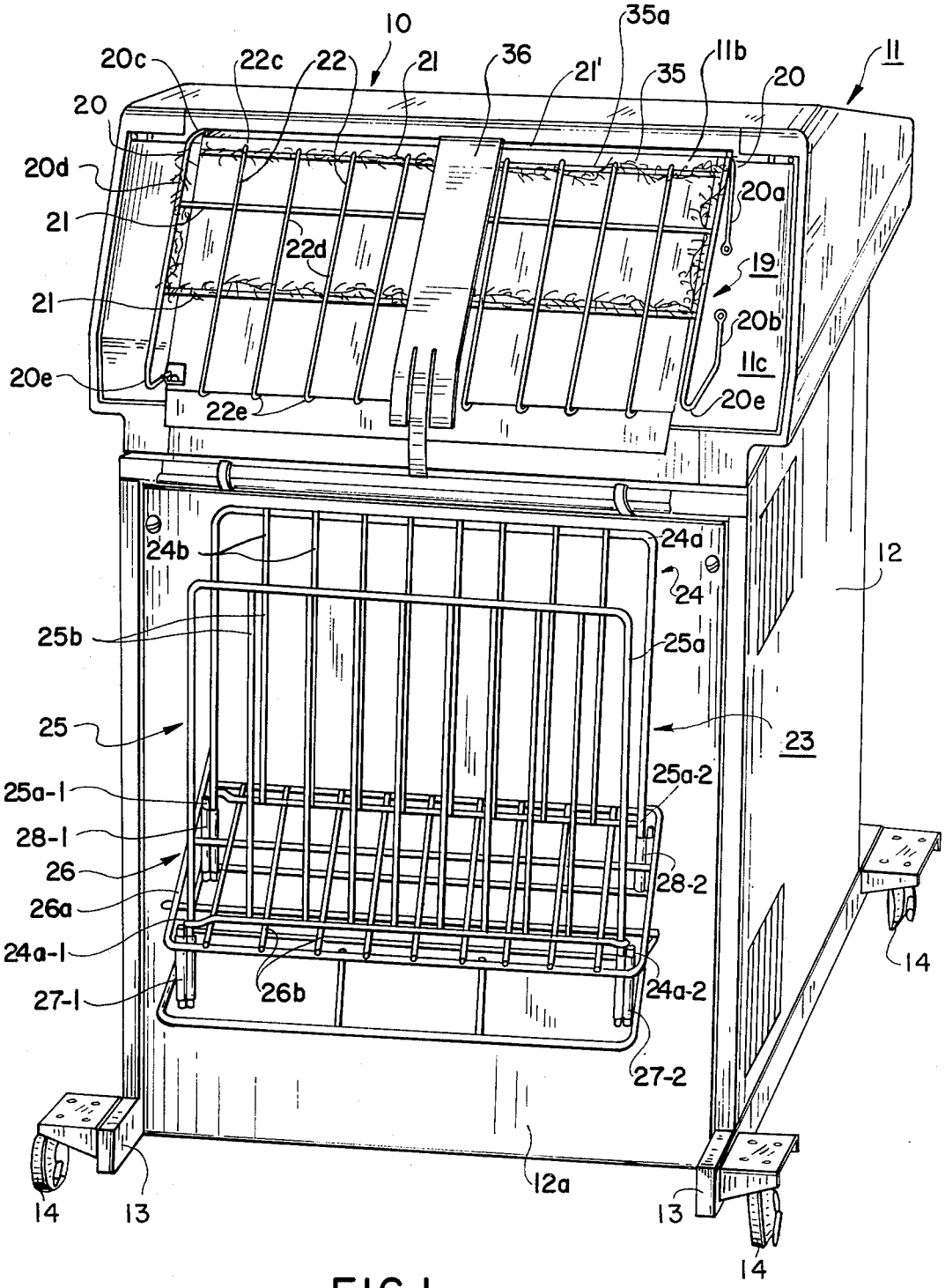
Figure 1A:
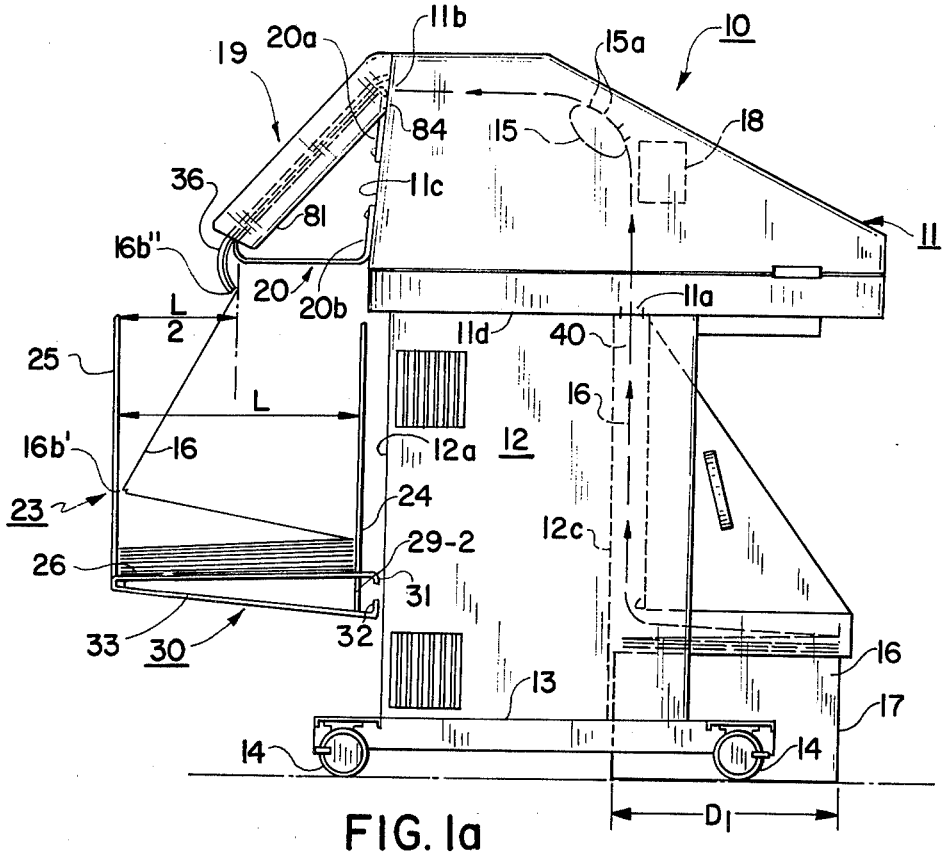
Figure 2:
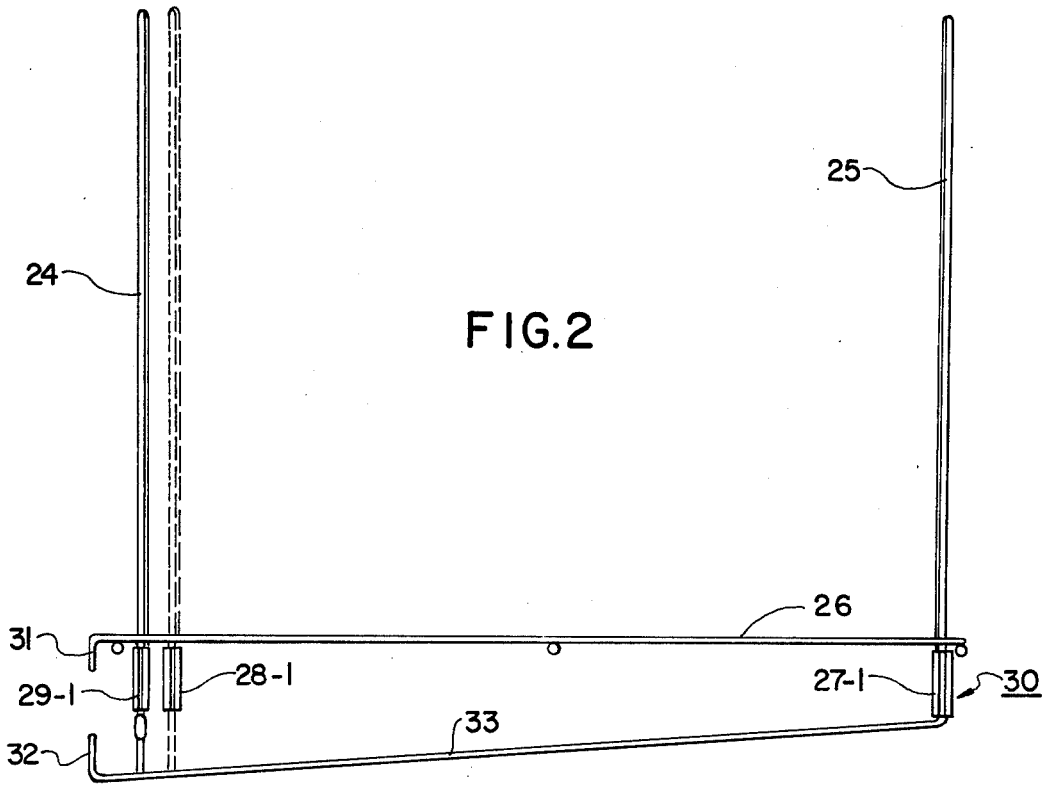
FIG. 2 shows a side elevational view of the paper basket of FIGS. 1 and 1*a*.
Figure 4:
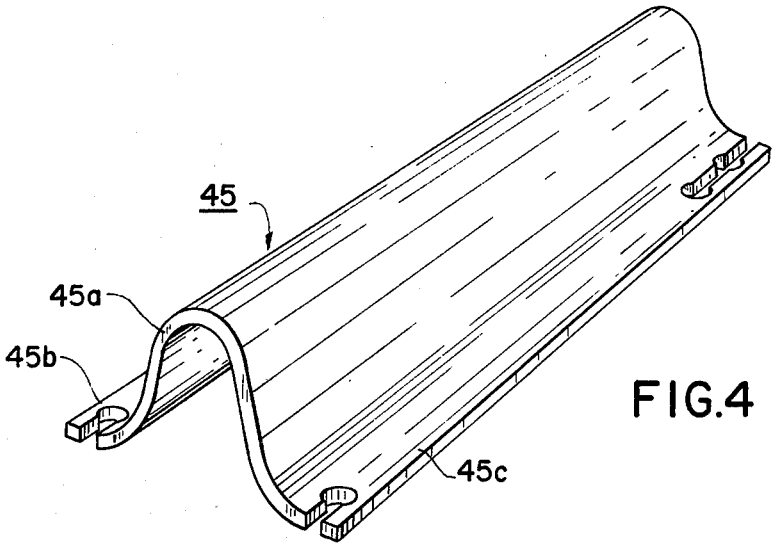

FIG. 4 shows a perspective view of the wedge which may be employed with the paper basket of FIGS. 1, 1*a*, and 2.

Figure 4A:
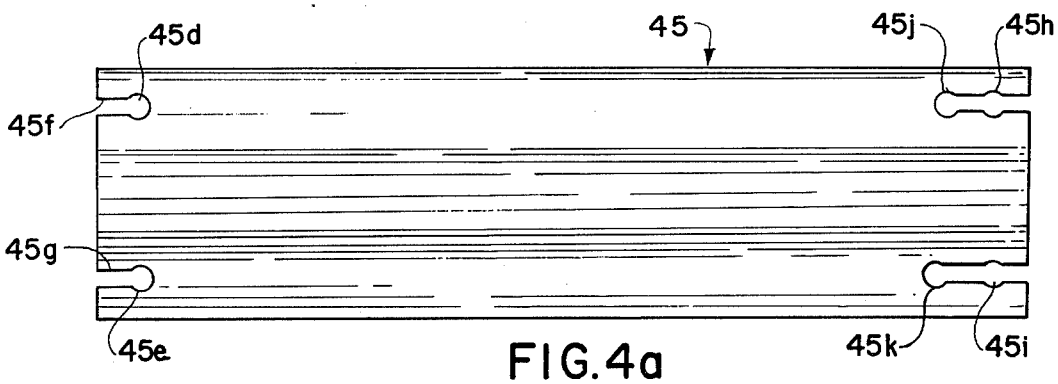

FIG. 4*a* shows a top plan view of the wedge of FIG. 4.

Figure 5:
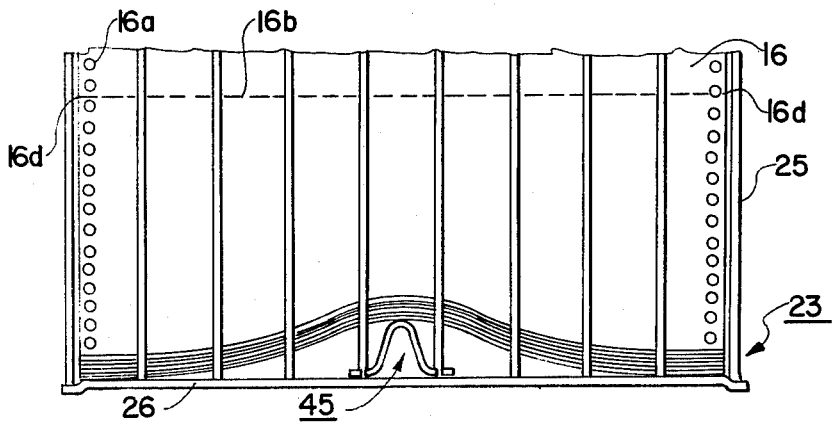

FIG. 5 shows a rear elevational view of the wedge mounted within the paper basket, which view serves to explain the manner in which the wedge assists in the neat stacking of fanfold paper.

Figure 5A:
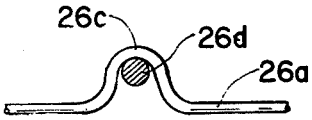

FIG. 5*a* shows a wedge arrangement which may be used in place of that shown in FIG. 5.

DETAILED DESCRIPTION OF THE INVENTION

FIGS. 1 and 1*a* show a printer system 10 including a printer mounted within an enclosure 11, the enclosure being supported upon a printer stand 12 having feet 13, preferably provided with casters 14 to facilitate rollingly positioning the printer assembly.

The printer mechanism includes a pair of paper drive means, which may be in the form of tractor assemblies 15, which tractor assemblies are provided with outwardly extending pins 15*a* for entering into spaced apertures 16*a* (see FIG. 5) provided at equispaced intervals along both sides of the paper 16.

The paper 16 is arranged in a fanfold manner within a paper box 17, and is drawn upwardly through a lower inlet slot 11*a* provided in the printer mechanism enclosure 11, by the tractor assemblies 15. Printing may, for example, occur by incrementally advancing the paper by one line, moving a printing mechanism 18 in a direction transverse to that of the movement of the paper through the printer so as to print a line or any portion thereof across the paper sheet, and then advancing the paper in readiness for printing the next line of print, this procedure being repeated continuously. Alternatively, the paper may be moved at what is commonly referred to as a "slew" rate in order to move the paper over large distances, i.e., distances many times greater than one line advance to reduce the time required to move the paper between the last line of print and the next line of print, which may be several inches away from the aforesaid last line of print. In any case, the printer has a capability of printing at high speed, typically on the order of 600 lines per minute. One printer which may utilize the paper stacking system of the present invention to great advantage is the Series 6000 printer manufactured by the Centronics Data Computer Corporation. The printer comprises a close-loop band cooperating with a plurality of independently operating print hammers printing a line of print at the aforementioned speeds. The tractor assemblies may be of the type described in U.S. Pat. No. 3,930,601, issued Jan. 6, 1976 to the assignee of the present invention. It should be understood, however, that the paper stacking system of the present invention may be utilized with any paper drive and/or printer other than that referred to hereinabove, so long as the printer is adapted to accommodate fanfold paper and/or forms.

The printer mechanism enclosure is further provided with an outlet opening 11*b* wherein paper is guided from the tractor advancing assemblies 15 through outlet opening 11*b* and downwardly along the lower paper guide extender 19 comprising a pair of rod-shaped end elements 20, 20 having their inwardly bent free ends 20*a* and 20*b* fastened to the rear surface 11*c* of the printer mechanism enclosure 11 and having secured thereto a plurality of horizontally aligned wireform cross pieces 21. A plurality of rod-shaped wireform members 22 are arranged in spaced parallel fashion relative to end elements 20 and relative to one another, said rod-shaped wireform members 22 and end elements 20 each being bent into substantially the same curvature so as to have a curved portion 20*c*, 22*c*, a diagonally aligned middle portion 20*d*, 22*d*, and a curved bottom portion 20*e*, 22*e*.

The paper passes through the outlet slot 11*b* and is urged by gravity to follow the curved upper contours 20*c* and the diagonally aligned intermediate portions 20*d* so as to fall substantially vertically downward from the curved portions 20*e*, 22*e*.

A paper basket 23 is positioned below the lower paper guide extender and is comprised of two upright side walls 24 and 25 and a floor portion 26. Each of the upright side walls is formed of a bent continuous rod 24*a*, 25*a* and a plurality of intermediate spaced parallel rods 24*b*, 25*b* secured to the rods 24*a*, 25*a*, preferably by welding. The floor 26 is similarly provided with a bent rod 26*a* having welded thereto a plurality of intermediate spaced parallel rods 26*b*.

The lower ends 24*a*-1 and 24*a*-2 of rod 24*a* and the lower ends 25*a*-1 and 25*a*-2 of rod 25 are adapted to be releasably mounted within cylindrical posts 27-1, 27-2 and 28-1, 28-2 so as to facilitate assembly and disassembly for shipping and packing purposes.

A second set of cylindrical posts 29-1, 29-2 are provided immediately behind the pair of posts 28-1, 28-2 so as to permit the side wall 24 to be positioned at two different distances from side wall 25 in order to accommodate the two standard sizes of fanfold paper, one of which is commonly used in the United States and the other of which is commonly used throughout Europe.

The floor 26 and side walls 24 and 25 are mounted upon a supporting bracket structure 30 having vertically aligned support elements 31, 32 fastened to the rear surface 12*a* of stand 12. Diagonally aligned bracing rods 33 extend between members 32 and 27-1 and 27-2.

A thin filament metallic tinsel-like material 35, which may be loosely wound about a conductive core 35*a*, extends along two of the support rods 21 of the lower paper guide extender 19 in the manner shown so as to ground any static electricity which may be carried by the paper to prevent the static electricity from affecting paper stacking.

An upper paper forming guide 36 is positioned to rest lightly upon the central portion of the lower paper guide extender 19 and, as can best be seen in FIGS. 3 and 3*a*, it is comprised of a thin sheet of plastic of generally rectangular shape. One end is provided with first and second pairs of apertures 36*a* and 36*b*, while the opposite end is provided with a centrally located tongue 36*c* extending beyond two side tongues 36*d* and 36*e*. Slits 36*f* and 36*g* extend inwardly from the right-hand ends 36*h* and 36*i* to form the tongues 36*d* and 36*e* which are free to move independently of tongue 36*c* and independently of one another.

The left-hand end of guide 36 is folded over in the manner shown best in FIG. 3*a* to receive an elongated strip 37 (shown in dotted fashion in FIG. 3) and provided with openings coaligned with the pairs of openings 36*a* and 36*b* so as to receive fastening means 38 and thereby define a closed loop 39 which encircles an upper horizontal crossrod 21' (shown in dotted fashion in FIG. 3*a*) and serves to mount the upper paper forming guide.

The guide is preferably formed of a suitable plastic material which has been pretreated so as to provide the guide with a permanent curvature or curl, basically in the manner shown in FIGS. 1 and 3*a*.

Stacking takes place in the following manner.

The paper 16 is neatly stacked in box 17 and is lifted vertically upward along the path as shown by the dotted line in the direction shown by the arrows 40 (see FIG. 1*a*). The paper is advanced in either continuous or incremental fashion, depending upon the particular type of printer in which the paper is used, and it is guided into slot 11*a* and through the printer mechanism enclosure 11 along the path as shown so as to exit through the outlet slot 11*b* and diagonally downward along the lower paper guide extender 19 and beneath the upper paper forming guide 36.

The paper moves downwardly from the diagonally aligned portions of 22*d* of rod members 22 so as to fall generally downwardly. The tongues 36*c*, 36*d* and 36*e* tend to urge the paper to generally follow the curvature of the curved portions 22*e* of rods 22. Although the paper is a substantially continuous sheet of indeterminate length, the paper web is actually perforated wherein a plurality of narrow elongated slits are arranged along an imaginary straight line as shown in FIG. 5 forming perforations 16*b* which facilitate tearing of the paper therealong and which further identify the breaks or bends at which the paper will fold to form the fanfold or accordian-pleated stack. The perforations are arranged in spaced parallel fashion and, for one size paper, are typically spaced 11 inches apart.

Considering FIG. 1*a*, the last perforation 16*b*′ can be seen to have almost stacked flat and adjacent to the inner side of wall 25 so that the next perforation 16*b*″ should fall adjacent to the side wall 24 of paper basket 23. The three tongues serve to induce the paper to follow the lower curved portion 22*e* of the lower paper guide extender rods 22 to cause the paper to break along the perforation 16*b*″ in readiness for stacking. The perforation 16*b*″ is the crucial one to control inasmuch as the perforation 16*b*′ normally breaks properly even without the guide member 36. The curvature and thickness of guide 36 is chosen to establish a force sufficient to induce the formation of an inside bend or fold at the perforation 16*b*″ and not so great as to induce the improper formation of an outside bend or fold at the perforation 16*b*′. Without guide 36 the paper 16 does not break at 16*b*″ and would otherwise travel along a substantially straight line diagonally downward and towards the paper basket sidewall 25 resulting in improper stacking and, in some cases, the paper may even ride over the top edge of sidewall 25. Thus, in the opposite case, wherein the perforation 16*b*′ has been the last perforation to be fed into the paper basket and now lies adjacent side wall 24, the upper paper forming guide is sufficiently resilient to allow the perforation 16*b*″ to form an outside fold to stack against sidewall 25 and thereby be assured of proper stacking. It has been found that providing the upper paper guide member 36 with three tongues as described hereinabove serves to impart two successive "pushing" actions upon the paper to further enhance the neat stacking of the fanfold paper.

An alternative design is shown in FIG. 3*b* wherein the inner tongue 36*c*′ is shorter in length than the outer tongues 36*d*′ and 36*e*′ to provide the same "double-push" action with a reversal of tongue design.

If desired, a similar plastic flap can be used between the paper and the paper guide extender to prevent the paper from sticking to the frame guide due to any electrostatic attraction.

The side walls 24 and 25 of the basket 23 are preferably spaced one-quarter inch wider than the paper sheets to accommodate both U.S. and European sizes. Thus, the space between side walls for European papers is preferably twelve and one-quarter inches, while the spacing between side walls to accommodate U.S. paper is eleven and one-quarter inches.

In the paper guide extender, the wire forms are formed of a suitable conductive metal to enhance conduction of any electrostatic charge in the paper to the wire form. In one preferred embodiment, the wire forms have been nickel plated. However, any other suitable forms may be employed.

The best paper stacking results have been obtained when the lower curved portion 22*e* of the wire forms 22 is positioned along an imaginary vertical line which is substantially one-half the distance between side walls 24 and 25. For example, if the distance between side walls 24 and 25 is assumed to be L, then the distance between imaginary line L1 and side wall 25 is of the order of L/2. Tolerance of the order of ±15% of L/2 has been found to yield satisfactory results for stacking. As was mentioned hereinabove, wire paper baskets of conventional design allow the folding of three to five sheets of paper before intervention of a technician was necessary.

Designs embodying the principles of the present invention were tested and it was found that these units would stack over ten inches of paper before technical intervention was needed. Then it was only a matter of simply removing the accumulated paper as opposed to readjusting a poorly aligned stack.

FIGS. 4 and 5 show still a further technique which has been employed very successfully to enhance the neat stacking of the fanfold paper.

As shown therein, wedge 45 is positioned either upon or slightly above the floor 26 of the basket 23. The wedge 45 is positioned intermediate the left and right-hand sides of floor 26 (relative to FIG. 5) and substantially parallel to the perforated sides of the paper 16. In the preferred embodiment, the wedge has a height of the order of one inch and is curved to support the central portions of the sheets a spaced distance above floor 26 of the paper basket to impart an inverted, rather V-shaped curvature to the sheets stacked thereon. This arrangement has been found to prevent the corners 16*d* where the paper bends along a perforation 16*b* from entering into any of the apertures 16*a* within the last sheet which has been stacked upon the floor 26 of paper basket 23. The wedge support serves to center the last perforation lowered upon the stack so as to prevent the next perforation to be lowered upon the stack from falling upon the stack in an uneven or skewed manner.

The wedge-like member 45 may take any one of a variety of shapes or forms. For example, the wedge may be a substantially V-shaped or U-shaped member or may alternatively be a single rod extending across the width of the floor of the paper basket 26 and may be either permanently or releasably secured to the basket.

FIGS. 4 and 4*a* show one exemplary embodiment of the present invention wherein the wedge-shaped support 45 has a substantially V-shaped cross-sectional configuration wherein the apex 45*a* has a curved contour and in the outer ends of the V-shaped portion curve outwardly to form flanges 45*b* and 45*c*. The lower ends of flanges 45*b* and 45*c* are provided with openings 45*d* and 45*e* having narrow neck portions 45*f* and 45*g* in order to snap fittingly receive two of the upright wire elements 25*b* of paper basket side wall 25. The upper ends of flanges 45*b* and 45*c* are formed with a pair of elongated slots, each having snap fitting slot portions 45*h*, 45*i*, 45*j* and 45*k* for snap fittingly receiving an embracing wire form uprights 24*b* of the paper basket side wall 24. For example, when side wall 24 is positioned within the supporting bracket sockets furthest removed from side wall 25, the wire form members 24*b* snap fittingly received within the regions 45*h* and 45*i* of the upper slots. Similarly, when side wall 24 is positioned within the sockets to locate side wall 24 closest to side wall 25, the wire form uprights **24*b* are snap fittingly received by the embracing portions 45*j* and 45*k*, respectively. Thus, the arrangement of FIGS. 4 and 4*a* teach a "wedge" support of a releasable design. Obviously, many other alternative arrangements may be provided so long as they serve the function of supporting the central portion of the paper sheets stacked within paper basket 23 a slight distance above the side edges of the paper sheets. For example, the wedge element may be in the form of a single rod of circular shaped cross-section which may either be permanently affixed to the side walls or releasably secured to the side walls of the paper basket. As another alternative, the bent frame forming rod 23*a* of paper basket floor 23 may be bent up along its opposite parallel sides into an inverted V-shaped configuration and a single wire form rod may be secured to the applied underside of the inverted V-shaped contours 26*c* in the bent wire portions 26*a* as shown best, for example, in FIG. 5*a***.

Each of the above-mentioned arrangements serves to enhance neat stacking of the fanfold paper web, and their use in combination obviousy cumulatively advances these objectives even further. The upper paper guide technique serves to counteract the deleterious effect that wind currents, drafts or any air movement within the region of the printer may have upon the paper web, especially as the web moves in the region between the lower end of the extender and its first point of contact within the paper basket or upon the stack, as the case may be. Although the upper paper guide is being preferably formed of a plastic material, other materials may be employed, including more durable material such as thin resilient metal, or even less durable materials such as a paper board or cardboard material. The lower paper guide extender may be formed of plastic, for example, and, if desired, be a single sheet having a contour similar to that of the wire form members 22 described hereinabove. The paper basket and its constituent components may, likewise, be formed of other suitable materials. Although the operation of the apparatus described hereinabove has been explained in connection with the stacking of a single-ply fanfold paper web, it should be understood that the apparatus is equally useful with multiple-ply paper webs and, in fact, with fanfold webs of any paper-like material or other materials for that matter.

Although this invention has been described with respect to its preferred embodiments, it should be understood that many variations and modifications will now be obvious to those skilled in the art, and it is preferred, therefore, that the scope of the invention be limited, not by the specific disclosure herein, only by the appended claims.

What is claimed is:

1. Apparatus for fanfolding transversely perforated elongated sheets of material, comprising:

an inclined chute having a substantially flat upper surface over which the sheets pass from an upper end of said chute to a lower end thereof; and a guide member having an elongated upper portion resting on said upper surface of said chute and a lower portion attached to said upper portion and terminating at a free end which extends beyond said lower end of said chute, said upper portion of said guide member being freely movable away from said upper surface of said chute in response to contact by a sheet passing between said guide member and said chute, said lower portion of said guide member being movable with said upper portion of said guide member, said free end of said lower portion of said guide member having a curved contour selected so that said guide member is generally concave relative to said lower end of said chute so as to temporarily impart a similar concave shape to the sheets after they pass said lower end of said chute, thereby facilitating the formation of inside folds in the sheets about the transverse perforations therein, said free end of said lower portion of said guide member having a resiliency selected so that said free end temporarily yields in response to contact by the sheets, thereby inhibiting the improper formation of outside folds in the sheets about the transverse perforations therein as a result of the concave shape imparted to the sheets by said free end.

2. Apparatus according to claim 1, further comprising a basket positioned below said chute so as to receive fanfolded sheets and having a floor and a pair of substantially parallel walls extending upwardly from said floor toward said chute, said pair of walls being spaced apart a distance at least equal to the distance between adjacent transverse perforations in the sheets.

3. Apparatus according to claim 2, wherein said lower end of said chute lies in a vertical plane positioned intermediate said pair of walls of said basket.

4. Apparatus according to claim 3, wherein said vertical plane is positioned halfway between said pair of walls of said basket within a tolerance range of $\pm 15\%$ D, wherein D is the distance between said pair of walls.

5. Apparatus according to claim 2, further comprising support means mounted on said floor for urging the sheets fanfolded in said basket into an inverted generally V-shaped configuration so that the central portion of each of the sheets in said basket is elevated above the opposite longitudinal edges of the sheet.

6. Apparatus according to claim 5, wherein said support means includes an elongated rod extending across said floor of said basket between said pair of walls thereof.

7. Apparatus according to claim 1, wherein said free end of said lower portion of said guide member includes a plurality of tongues, each of said tongues being movable independently of the other of said tongues in response to contact by a sheet passing between said guide member and said chute, at least one of said tongues having a curvature which is different from the curvature of the other of said tongues, whereby said guide member imparts a curved contour to a sheet passing between said guide member and said chute at two different locations beyond said lower end of said chute.

8. Apparatus according to claim 7, wherein said plurality of tongues includes three elongated tongues, including a central tongue and two end tongues, arranged side-by-side and generally parallel to a longitudinal axis of said guide member.

9. Apparatus according to claim 8, wherein said central tongue is longer than said two end tongues.

10. Apparatus according to claim 8, wherein said central tongue is shorter than said two end tongues.

11. In apparatus for fanfolding transversely perforated elongated sheets of material including an inclined chute over which the sheets pass from an upper end of said chute to a lower end of said chute and guide means cooperating with said chute for imparting a temporary curved contour to the sheets after they pass said lower end of said chute to facilitate the fanfolding of the sheets about the transverse perforations therein, the improvement wherein said guide means includes a plurality of resilient members and mounting means for mounting said resilient members so that each of said members extends beyond said lower end of said chute and is freely movable away from said chute in response to contact by a sheet passing between said guide means and said chute, each of said resilient members being movable independently of the other of said members and having a curved contour selected so that each of said members is generally concave relative to said lower end of said chute, at least one of said members having a curvature which is different from the curvature of the other of said members, whereby said guide means imparts a curved contour to a sheet passing between said guide means and said chute at two different locations beyond said lower end of said chute.

12. Apparatus according to claim 11, wherein said plurality of members includes three elongated tongues arranged side-by-side and generally parallel to a longitudinal axis of said chute.

13. Apparatus according to claim 12, wherein said central tongue is longer than said two end tongues.

14. Apparatus according to claim 12, wherein said central tongue is shorter than said two end tongues.

* * * * *